US006135359A

United States Patent [19]

Almasy et al.

[11] Patent Number: 6,135,359

[45] Date of Patent: Oct. 24, 2000

[54] HEATED YARD HYDRANT

[75] Inventors: Lawrence Almasy; James F. Shuler, both of Colorado Springs, Colo.

[73] Assignee: WCM Industries, Inc., Colorado Springs, Colo.

[21] Appl. No.: 09/469,807

[22] Filed: Dec. 22, 1999

[51] Int. Cl.[7] ..... B05B 1/24

[52] U.S. Cl. ..... 239/135; 239/139; 137/341

[58] Field of Search ..... 239/13, 128, 133, 239/135, 139; 392/485, 487–489, 497, 503, 479, 480, 483; 137/341; 219/544

[56] References Cited

U.S. PATENT DOCUMENTS

| | | | |
|---|---|---|---|
| 926,185 | 6/1909 | Hayes | 239/135 |
| 962,294 | 6/1910 | Armington | 239/135 |
| 1,426,407 | 8/1922 | Pennington | 239/135 |
| 2,429,940 | 10/1947 | McDaniel | 219/544 |
| 2,484,063 | 10/1949 | Ackley | 137/341 |
| 4,700,732 | 10/1987 | Francisco . | |
| 4,909,270 | 3/1990 | Enterante, Sr. et al. . | |
| 5,246,028 | 9/1993 | Vandepas . | |
| 5,590,679 | 1/1997 | Almasy et al. . | |
| 5,632,303 | 5/1997 | Almasy et al. . | |
| 5,701,925 | 12/1997 | Mulligan et al. . | |

*Primary Examiner*—Andres Kashnikow
*Assistant Examiner*—Lisa Ann Douglas
*Attorney, Agent, or Firm*—Zarley, McKee, Thomte, Voorhees & Sease

[57] ABSTRACT

A freezeless yard hydrant comprises a single length, electrically heated, hydrant apparatus that does not have an underground drain port. The operating mechanisms are located in the outlet head, above ground, to facilitate the assembly, operation and repair of the hydrant. A single length heater is provided to prevent the hydrant and the water supply connection from freezing under the coldest environmental conditions expected where this type of hydrant would be used. Heat conduction through the water directly from the heating element and the casing materials permits a single length hydrant and heater to be used. By using the electric heater to prevent the freezing, the water does not have to be drained out of the hydrant. The use of such a heater also makes the hydrant very simple to construct and operate. No cumbersome reservoirs or expulsion apparatus are needed to draw water out of the hydrant. This results in an efficient and relatively inexpensive mechanism. The outlet of the hydrant is located above ground in the manner of the typical drain-downyard hydrant, allowing for access to a hose, or for other purposes such as filling buckets or open washing. The outlet of the hydrant is equipped with a hose threaded connection that is provided with either one check valve or two check valves to protect the hydrant from backflow at the hose connection.

9 Claims, 3 Drawing Sheets

HEATED YARD HYDRANT

BACKGROUND OF THE INVENTION

Conventional freezeless yard hydrants have an inlet valve connected to a water supply that is located below the frost line in the ground. When the hydrant is shut off, a drain port at the inlet valve is opened to allow the water in the hydrant to drain out, effectively making the hydrant freezeproof. The problem with this design is that ground water or other contaminants can enter the yard hydrant through the same drain port, thus creating an unacceptable cross-connection. Plumbing codes in the United States are being changed to prohibit the use of this conventional drain-down hydrant.

It is therefore a principal object of this invention to provide a heated yard hydrant which does not have an underground drain port.

A further object of this invention is to provide a heated yard hydrant wherein the operating mechanisms are located in the outlet head, above ground, thereby making the assembly, operation, and repair of the hydrant very easy and simple.

A further object of this invention is to provide a heated frost free yard hydrant which has no cumbersome reservoirs or other apparatus to draw water out of the hydrants.

These and other objects will be apparent to those skilled in the art.

SUMMARY OF THE INVENTION

A freezeless yard hydrant comprises a single length, electrically heated, hydrant apparatus that does not have an underground drain port. The operating mechanisms are located in the outlet head, above ground, to facilitate the assembly, operation and repair of the hydrant. A single length heater is provided to prevent the hydrant and the water supply connection from freezing under the coldest environmental conditions expected where this type of hydrant would be used. Heat conduction through the water directly from the heating element and the casing materials permits a single length hydrant and heater to be used. By using the electric heater to prevent the freezing, the water does not have to be drained out of the hydrant. The use of such a heater also makes the hydrant very simple to construct and operate. No cumbersome reservoirs or expulsion apparatus are needed to draw water out of the hydrant. This results in an efficient and relatively inexpensive mechanism. The outlet of the hydrant is located above ground in the manner of the typical drain-downyard hydrant, allowing for access to a hose, or for other purposes such as filling buckets or open washing. The outlet of the hydrant is equipped with a hose threaded connection that is provided with either one check valve or two check valves to protect the hydrant from backflow at the hose connection.

DESCRIPTION OF THE PREFERRED EMBODIMENT

Figure 1:
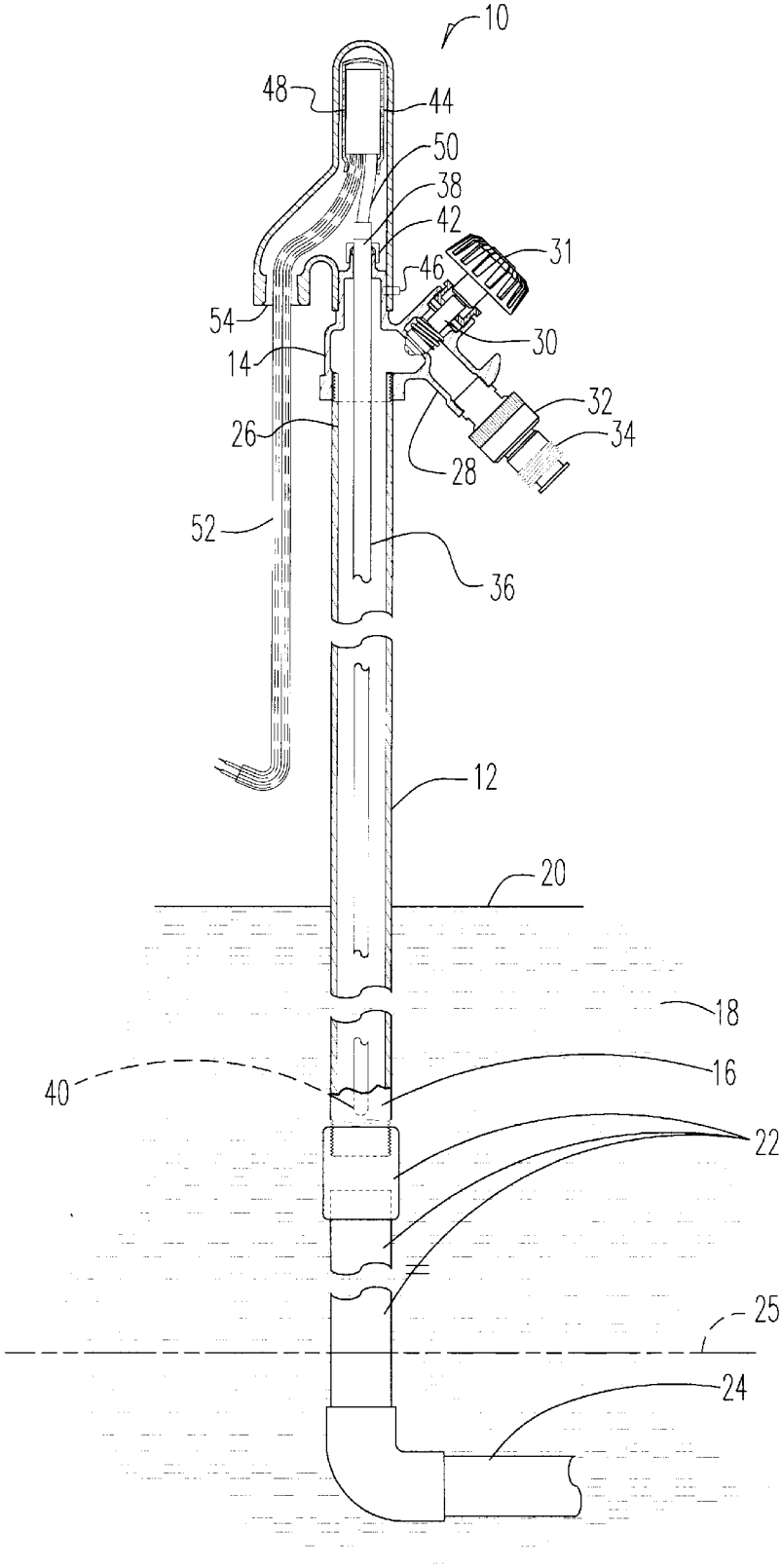
FIG. 1 is a vertical sectional view of the hydrant of this invention.
Figure 2:
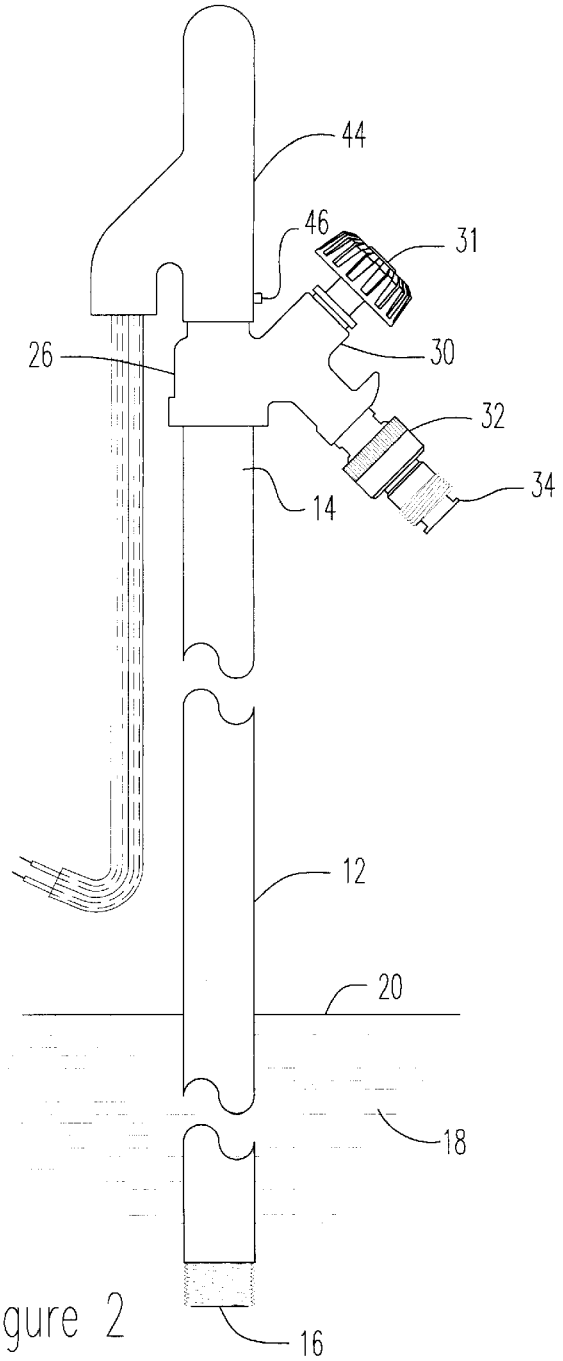
FIG. 2 is a side elevational view of the apparatus of FIG. 1.

The hydrant 10 is comprised of a vertically disposed pipe 12 which normally would be approximately one inch in diameter. Pipe 12 has an upper end 14 and a lower end 16. The lower end 16 is typically submerged in the ground 18 to a depth of approximately one foot. Coupling assembly 22 connects the lower end 16 to an inlet water pipe 24 which is connected to a source of pressurized water (not shown). The pipe 24 is located below frost line 25 which may be 42 inches or so below the ground surface 20.

A head casting 26 is tightly mounted in any conventional manner to the upper end 14 of pipe 12. A conventional fluid discharge conduit 28 extends downwardly and outwardly from head casting 26. Discharge conduit 28 includes a conventional closure valve 30 which is operated by a conventional wheel handle 31. A conventional check valve 32 is mounted in discharge conduit 28 to prevent any fluid flow inwardly from nozzle 34 towards the interior of either the head casting or the pipe 12.

Figure 3:
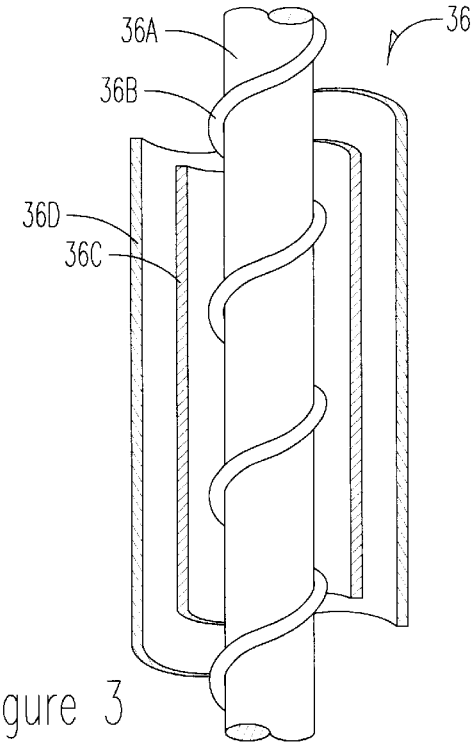
FIG. 3 is an enlarged vertical cross sectional view of the heating element.

An elongated rigid heating element 36 is positioned directly within the pipe 12. Heating element 36 (FIG. 3) is comprised of an elongated Fiberglas substrate 36A, around which is wound a nickle-chromium resistance wire 36B, which is covered with a flexible polymeric sheath 36C. Said flexible assembly is located within a rigid stainless steel tube or sheath 36D. Heating element 36 has an upper end 38 and a lower end 40. The upper end of heating element 36 extends through the top of head casting 26 and is tightly and rigidly secured thereto by compression nut and sleeve assembly 42.

A cap 44 fits over the top of head casting 26 and is removably but rigidly secured thereto by set screw 46 or the like. A heater thermostat 48 is mounted in any convenient way within cap 44 and is electrically connected to the upper end of heating element 36 by electrical connector 50. The thermostat 48 is electrically connected to a source of electrical power by line 52 which extends from the thermostat to a source of electrical power (not shown). The line 52 exits the cap 44 through exit port 54.

In operation, the line 52 is connected to a source of electrical power, but thermostat 48 does not transmit the power to heating element 36 unless the temperature is at or close to a freezing point. In such temperature conditions, the element 36 heats the water that dwells within pipe 12 and head casting 26 through direct contact with the water. Thus, the water throughout the length of pipe 12 is maintained above a freezing level by the element 36 regardless of the ambient temperature of the air on the outside of the pipe 12. The temperature of the water within fluid discharge conduit 28 is also maintained above the freezing level by virtue of its direct contact with the "heated" water within the head casting 26. Heat is also conveyed from the material of the head casting 26 to the material of the fluid discharge conduit 28. When a hose on nozzle 34 is removed, water in conduit 28 runs by gravity out of nozzle 34.

Figure 4:
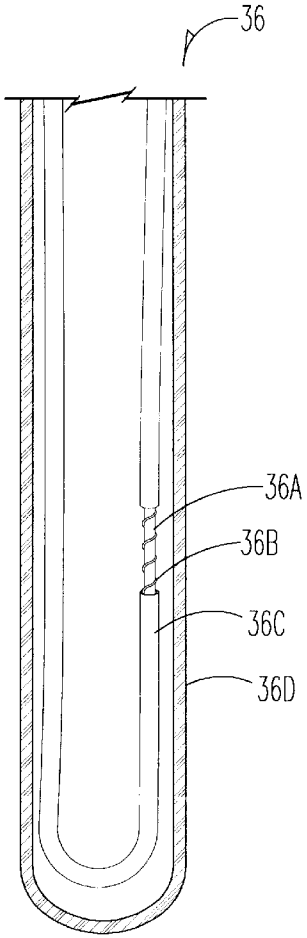
FIG. 4 is a sectional view of the heating element of FIG. 3.

FIG. 4 shows heating element 36 which has a Fiberglas substrate 36A; a nickle-chromium resistance wire 36B wound therearound; a flexible polymeric sheath 36C covering the wire 36B; and a rigid stainless steel sheath 36D.

Figure 5:
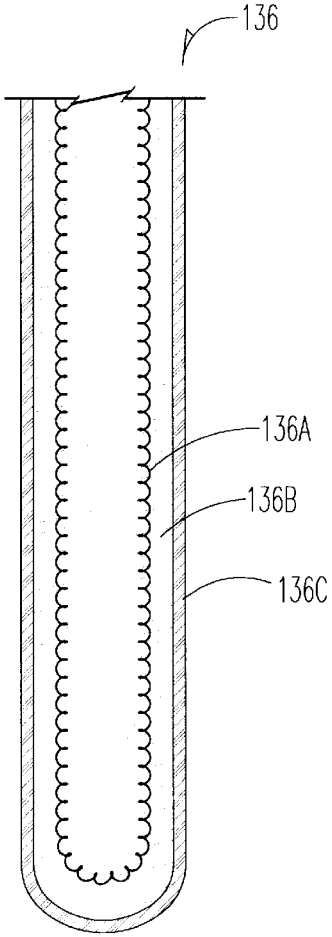
FIG. 5 is a sectional view of a first alternative heating element.

FIG. 5 shows a first alternative heating element 136 using a nickle-chromium resistance wire 136A, a magnesium oxide sand 136B therearound; and a rigid stainless steel sheath 136C.

Figure 6:
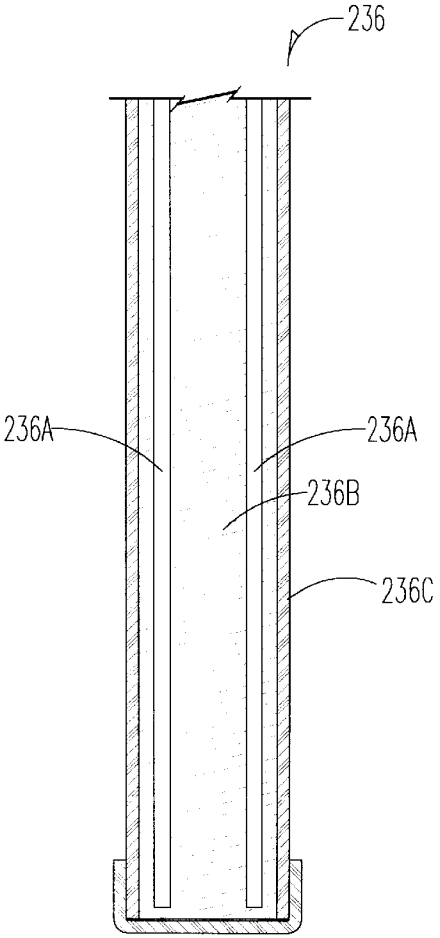
FIG. 6 is a sectional view of a second alternative heating element.

FIG. 6 shows a second alternative heating element 236 using a conductor 236A, a resistance medium (carbon) 236B; and a flexible polymeric sheath 236C.

The closure valve 30 is conventionally operated by the wheel handle 31 to allow fluid to be discharged from the hydrant. The check valve 32 prevents the reverse flow of fluid from the nozzle 34 back into the hydrant. The nozzle 34 is conventionally adapted to receive a hose or the like for the convenience of the operator.

The hydrant of this invention does not need any exterior drains to allow water to flow back into the ground 18. No special compartments or other devices are needed to purge water from the hydrant when the hydrant is in a closed condition even during the most severe cold weather. In the remote event that the structure above ground does fail if electrical power to the heating element failed, the device can be easily replaced by removing the structure above coupling 22, rather than by digging a substantial opening to gain access to the line 24 which dwells much deeper in the soil. ordinarily, if the water in the hydrant freezes, the ice in the hydrant will push the unfrozen water back into the supply line 24. The water in coupling 22 is heated by heating element 22 and the heated water in the pipe 12.

It is therefore seen that this invention will achieve at least all of its stated objectives.

What is claimed is:

1. A heated yard hydrant, comprising a vertical pipe having upper and lower ends, with the lower end adapted to be directly connected underground to a source of fluid under pressure to fill the vertical pipe with fluid, a means on the upper end of the vertical pipe closing the upper end to fluid flow, a fluid discharge conduit in a head casting extending downwardly and outwardly out of the head casting, a fluid closure valve in the discharge conduit to open and close the discharge conduit to fluid flow, an elongated electrical heating element in the vertical pipe extending downwardly from the head casting to the lower end of the vertical pipe, to permit the heating element to directly contact fluid in the vertical pipe, a cap secured to the head casting, an upper end of the heating element extending through the head casting in sealed relation thereto and protruding into the cap, a heater thermostat in the cap electrically connected to the upper end of the heating element, and adapted to be connected to a source of electrical power.

2. The device of claim 1 wherein a means is imposed in the fluid discharge conduit to prevent the flow of fluid therein towards the vertical pipe.

3. The device of claim 1 wherein the cap is removably secured to the head casting to permit easy access to the heating element for repair or replacement.

4. The device of claim 3 wherein the heating element is detachably secured to the head casting and is vertically removable therefrom when the cap is removed from the head casting.

5. The device of claim 4 wherein the heating element is secured to the head casting by a compression nut and sleeve assembly.

6. The device of claim 1 wherein the heating element is comprised of an elongated substrate member, a resistance wire wound around the substrate member, a polymeric coating covering the wire and substrate member, and a stainless steel protective outer sheath.

7. The device of claim 6 wherein the heating element is rigid.

8. The device of claim 1 wherein the heating element is comprised of a nickle-chromium resistance wire surrounded by a hollow rigid stainless steel sheath filled with magnesium oxide sand.

9. The device of claim 1 wherein the heating element is comprised of electrical conductors surrounded by a flexible polymeric sheath filled with resistance carbon.

* * * * *